United States Patent [19]

Dunlop et al.

[11] Patent Number: 4,915,802

[45] Date of Patent: Apr. 10, 1990

[54] METHOD FOR MAKING LOW ALPHA COUNT LEAD

[75] Inventors: John A. Dunlop, Veradale, Wash.; Edward F. G. Milner, Trail, Canada; Robert W. Smyth, Trail, Canada; Gerald W. Toop, Trail, Canada

[73] Assignee: Comino Ltd., Vancouver, Canada

[21] Appl. No.: 362,495

[22] Filed: Jun. 7, 1989

Related U.S. Application Data

[62] Division of Ser. No. 237,747, Aug. 29, 1988, Pat. No. 4,887,492.

[51] Int. Cl.[4] ..... C25C 3/00; C25C 3/34

[52] U.S. Cl. ..... 204/66; 204/141.5

[58] Field of Search ..... 204/66, 141.5

[56] References Cited

U.S. PATENT DOCUMENTS

| | | | |
|---|---|---|---|
| 2,092,451 | 9/1937 | Gibson et al. | 204/66 |
| 2,507,096 | 5/1950 | Dittmer | 204/141.5 X |
| 3,515,655 | 6/1970 | Raviv et al. | 204/141.5 X |
| 3,679,378 | 7/1972 | Impe et al. | 204/141.5 X |
| 4,420,380 | 12/1983 | Ducati | 204/66 |
| 4,701,246 | 10/1987 | Fujita et al. | 204/141.5 X |
| 4,770,698 | 9/1988 | Dunlop et al. | 75/77 |

*Primary Examiner*—Donald R. Valentine
*Attorney, Agent, or Firm*—Neil F. Markva

[57] ABSTRACT

Lead with a low alpha particle emission is produced by selecting an orebody wherein lead mineral is present in a coarsely disseminated form and substantially free of impurities. The ore is selected from a host rock that is relatively low in alpha emitters, such as a carbonate rock. The ore is mined and is milled such that the lead mineral can be separated from the host rock and any other minerals. The ground ore may be screened into one or more fractions having a narrow range of particle sizes. Each fraction is formed into a fluid suspension, and each suspension is subjected to gravity separation to remove the host rock and any other minerals which substantially contain the alpha particle-emitting substances, and to recover the lead mineral as a concentrate with a low alpha count. The lead concentrate is subjected to a suitable reduction operation that may include a conversion of the concentrate into a reducible form, without the introduction of alpha emitters, for the recovery of a low alpha lead. When the lead mineral is galena, suitable reductions include the smelting with sodiuim carbonate with or without an oxygen-bearing gas and electrolytic reduction in a molten bath of lead chloride. The low alpha lead recovered from these operations has an alpha count of about 0.02 alpha particle per $cm^2$ per hour or less, and the count does not substantially increase with time. The recovered low alpha lead may be further purified by electro-refining.

5 Claims, No Drawings

METHOD FOR MAKING LOW ALPHA COUNT LEAD

This is a division of application Ser. No. 237,747, filed Aug. 29, 1988, now U.S. Pat. No. 4,887,492.

BACKGROUND OF THE INVENTION

Lead is often used as a shielding material in radiation evaluation equipment in order to reduce the system background radiation. Lead, however, contains small amounts of radioactive isotopes including lead-210, bismuth-210 and polonium-210.

In electronic devices, lead and lead alloys are often used in contacts and solder pads. Integrated circuit memories can suffer from soft errors that can destroy the data in a memory cell and are caused by the alpha particles emitted from the decay daughters of Pb-210, particularly Po-210. Pb 210 has a half-life of 22 years.

Po-210 is well-known as a source of alpha particle emission and it is, therefore, of prime importance to use a lead that has a low alpha particle emission, especially in the above-mentioned applications. The emission is usually measured as a count expressed in the number of alpha particles emitted per $cm^2$ per hour (alpha count hereinafter). Commercially available lead has alpha counts that may vary from as low as 0.25 to as high as 10 and, unless each batch of lead is analyzed for its alpha count, there is no method for predicting which commercial lead has a low count. There is no commercial process known whereby the Pb 210 can be easily removed from commercial lead. Japanese Patent 59-64 791 describes producing a low alpha lead, containing $<50$ ppb radio isotopes and an alpha count of $\leqq 0.5$, by electrolyzing a sulfamic acid-lead electrolyte using a lead anode. In spite of the fact that Pb-210 has a half life of 22 years, even lead that is several hundred years old, such as recovered from sunken ships or from church roofs in Europe, has counts of 0.03 to 0.07. These alpha counts are much higher than the level required for electronic devices and integrated circuits. The desired alpha count in the electronics industry is 0.02 or less.

Zone refining, which is a successful method for removing substances that emit alpha particles (alpha emitters hereinafter) from aluminum, does not remove Pb-210 from lead. Although a temporary decrease in alpha count is obtained when lead is zone refined with the initial removal of Bi-210 and Po-210, the count increases again with time to its original level as secular equilibrium is regained, indicating that Pb-210 is not removed.

SUMMARY OF THE INVENTION

The invention is based on the discovery that alpha emitters in lead mineral-containing orebodies are associated with the host rock. Thus, we have found that lead with a low alpha particle emission, i.e. low alpha lead, can be simply produced by carefully selecting the orebody, recovering the lead mineral as a concentrate and reducing the concentrate without the introduction of alpha emitters.

More particularly, we have found that by mining a lead deposit that contains lead mineral in a coarselydisseminated form, substantially free from impurities, in a host rock with associated minerals that are relatively low in alpha emitters, milling the mined ore and subjecting the ground ore to a gravity separation, the alpha particle-emitting host rock or gangue and associated minerals are effectively removed, and a lead concentrate is obtained that has a low alpha count. Subjecting the concentrate to a suitable reduction operation without the addition of any material that can introduce alpha emitters, yields lead metal that has an alpha count of about 0.02 or less. Suitable reduction operations comprise the reductions of sulfidic lead minerals with sodium carbonate in an oxidizing atmosphere or in a non-oxidizing atmosphere, or with hydrogen, iron or charcoal, and the reduction in a bath of molten lead chloride with the application of an electric current, provided that these materials have a low alpha count. The reduction may also include a prior conversion step to convert the concentrate into a form suitable for reduction. The reduction, as herein described, is understood to include a prior conversion as required. As desired, the lead recovered from a reduction may be subjected to electro-refining to reduce its impurity content.

Accordingly, there is provided a method for the production of lead with a low emission of alpha particles which comprises the steps of selecting an orebody containing lead mineral in a coarsely-disseminated form substantially free of impurities, and in a host rock together with associated minerals and relatively low in alpha emitters; mining said orebody to produce mined ore; milling said mined ore to form ground ore having particle sizes such that separation of lead mineral from said host rock and associated minerals can be effected; forming a fluid suspension of said ground ore; subjecting said suspension to gravity separation to remove said host rock and associated minerals from said lead mineral; recovering said lead mineral as a concentrate; subjecting said concentrate to a reduction; and recovering lead having an alpha count of 0.02 alpha particle per $cm^2$ per hour or less.

It is, therefore, an object of the present invention to provide a method for producing low alpha lead. It is another object to provide an economical method for producing large quantities of low alpha lead on a commercial scale. These and other objects of the invention will become apparent from the following detailed description.

DESCRIPTION

Lead occurs mainly as galena but also in the form of carbonate, and sulfate, as well as in other forms. The lead minerals usually occur in combination with other minerals and impurities many of which are alpha emitters. The lead minerals are present in host rocks, many of which are relatively high alpha emitters, i.e., relatively high in uranium and thorium and, consequently, high in the Pb-210 isotope. Other host rocks, especially the carbonate-type host rocks that are usually of a sedimentary type, are relatively low alpha emitters, i.e., relatively low in uranium and thorium, and hence relatively low in Pb-210. Moreover, in many deposits the lead mineral is present in a finely-disseminated form, that is closely associated with impurities. Unless treated in a complex and expensive manner, it is generally not possible to separate the lead mineral from such deposits into a concentrate that can yield low alpha lead.

In order to produce lead with a low alpha count it is, therefore, necessary to select deposits wherein the lead mineral is present in a coarsely-disseminated form substantially free of impurities. Such deposits include the carbonate-type orebodies at Polaris on Little Cornwallis Island and at Pine Point in the Northwest Territories, and at Bixby, Mo. These orebodies all contain galena as the main lead mineral as well as some oxidized lead forms. The galena is present in a coarsely-disseminated form substantially free of impurities in a host rock that has an alpha count of less than about one alpha particle per $cm^2$ per hour.

It is pointed out that low alpha lead can be made directly by reducing pure galena, which can be recovered such as by hand-picking from ore bodies. Such a recovery is, however, not an economical method for producing low alpha lead on a commercial scale.

After selecting an orebody with coarsely-disseminated lead mineral substantially free of impurities in a host rock relatively low in alpha emitters, i.e., preferably having an alpha count of less than about one, the ore is mined in the usual well-known manner to produce a mined ore. The mined ore is milled to produce a ground ore. The milling is carried out to a degree sufficient to be able to separate the lead mineral from the host rock and the associated minerals. Depending on the ore, a coarse-milling is usually adequate for effecting a subsequent separation of mineral from rock and the associated minerals. Milling of ore obtained from the above-mentioned orebodies to particle sizes smaller than about 35 mesh (Tyler Standard Screen Scale Sieves Series) is preferable. The milling is carried out using a known method and known equipment.

The ground ore is formed into a fluid suspension suitable for separation of the lead mineral from the host rock and associated minerals by gravity separation. In one embodiment, the ground ore is mixed with water to form an aqueous suspension. The suspension is then subjected to a gravity separation using known equipment such as a spiral, a Wilfley or Deister Table or other suitable gravity separation equipment. In a second embodiment, the ground ore is formed into a fluid suspension using air as the medium to form a gaseous suspension and subjected to gravity separation.

A gravity separation is more efficient when the particles in the fluid suspension are substantially of the same size. Preferably, therefore, the ground ore is subjected to a sizing operation, such as by screening or hydro-sizing, prior to forming the fluid suspension, to form a fraction with a narrow range of particle sizes of the ground ore. Preferably, such a fraction may have particle sizes in the range of about minus 35 to plus 325 mesh. It is understood, however, that other particle size ranges such as, for example, the minus 325 mesh fraction, may be used to give the desired results. Preferably, the ground ore is separated into a range of narrow particle size fractions, each fraction being formed into a fluid suspension which is subjected to a gravity separation for the formation of a lead mineral-containing concentrate separated from host rock and associate minerals. For example, three particle size fractions may be formed by screening or hydro-sizing, these fractions having particle sizes in the ranges of about minus 35 to plus 100 mesh, about 100 to plus 200 mesh, and about 200 to plus 325 mesh, respectively.

The gravity separation of a fluid suspension of ground ore is effective in separating the host rock that substantially contains the alpha emitters, especially Pb-210, and the associated minerals, from the lead mineral-containing concentrate.

The lead concentrate is subjected to a suitable reduction operation for the recovery of lead metal that has a low alpha count. Optionally, the concentrate may be subjected to a washing or etching operation prior to reduction. The washing or etching may be carried out to remove residual host rock and associated minerals, and may be effected with organic chemicals or hydrochloric acid substantially free of alpha emitters. It is understood that a suitable reduction may include a conversion of the concentrate into a form that is reducible to lead with a low alpha count. For example, such a conversion may be the conversion of lead sulfide into lead oxide, lead chloride, lead carbonate or like lead compounds that can be subjected to electrolytic reduction for the recovery of lead with a low alpha count.

The reduction process must be a simple reduction, because the more complex processes used in large-scale commercial lead smelting operations routinely require the use of additives and fluxes that generally are alpha emitters. The commercially-used smelting processes are, therefore, not suitable for reducing the lead concentrate, not even pure galena, to a low alpha lead.

Suitable reduction processes comprise reductions of the lead concentrate with, for example, hydrogen, iron, or charcoal, and the electrolytic reduction in a bath of molten lead chloride as electrolyte. These reductions are well-known. The reducing agent or electrolyte must be a material that has no or a low alpha count. When reducing a lead concentrate, it is also desirable to avoid the evolution of noxious gases, such as hydrogen sulfide and sulfur dioxide. The preferred reduction processes using a low alpha count reducing agent and without the evolution of noxious gases are the processes of smelting lead sulfide (galena) concentrate with sodium carbonate with and without the addition of an oxygen-bearing gas. In the reduction of the concentrate with sodium carbonate with the addition of an oxygen-bearing gas, sodium chloride is added as a fluxing agent to form a low melting point salt phase. The sodium chloride and the sodium sulfate formed during smelting form a low melting point salt phase at about 600° C. Both sodium carbonate and sodium chloride must have no or a low alpha count. The oxygen-bearing gas is chosen from the group consisting of oxygen, air and oxygen-enriched air. The smelting reaction in the presence of oxygen takes place according to the following equation: $2PbS+2Na_2CO_3+3O_2+2NaCl \rightarrow 2Pb+2(NaCl.Na_2SO_4)+2CO_2$ Preferably, the lead sulfide concentrate is mixed with an excess of sodium carbonate and sodium chloride, and is smelted in a suitable vessel, made of a material with a low alpha count such as graphite, with the lancing of oxygenbearing gas. The molten lead is easily separated from the molten salt, and lead metal is recovered as low alpha lead with an alpha count of about 0.02 alpha particle per $cm^2$ per hour or less.

The smelting reaction with sodium carbonate in the absence of oxygen, i.e. reduction without the addition of an oxygenbearing gas, takes place according to the following equation:

$$4PbS+4Na_2CO_3 \rightarrow 3Na_2S+Na_2SO_4+4CO_2+4Pb^{\circ}$$

The reaction occurs with the evolution of a considerable amount of carbon dioxide. In order to control the reaction, the charge mixture, which is a well mixed blend of appropriate amounts of lead sulfide concentrate and sodium carbonate, is continuously fed at a low and steady rate into a bath of hot reacted material. The reacted material, i.e. sodium sulfide, sodium sulfate and lead, is contained in a suitable vessel made of a material with a low alpha count, e.g., graphite. By only partly filling the vessel, thus leaving considerable freeboard, the reaction is further controlled. The feed mixture preferably contains an excess of sodium carbonate, e.g., 10 to 15% excess. If desired, the feed mixture may also contain an amount of sodium chloride, which will tend to lower the temperature of the reacted material, i.e. the matte. The reaction commences at a temperature of about 850° C. and may be carried out at temperatures as high as 1300° C. Preferably, the temperature is maintained at about 1050° C. At this temperature the steady input of new feed charge causes a rapid reaction with manageable evolution of carbon dioxide.

The molten lead collects in the bottom of the vessel and is recovered therefrom as a low alpha count lead with an alpha count of about 0.02 alpha particle per $cm^2$ per hour or less. Optionally, the molten lead recovered from the smelting vessel may be further purified by first treating with a small amount of sodium hydroxide and then with a small amount of an oxygen-bearing gas to reduce the sulfur and sodium sulfide contents.

The gases from the smelting vessel consist mostly of carbon dioxide and small amounts of PbS, PbO, $SO_2$, $Na_2SO_4$ and, if used, NaCl. The off gases are conventionally treated using a baghouse or scrubber. The salt phase, or matte, from the smelting vessel is removed from the process. If desired the matte may be quenched in and leached with water while being agitated and subsequently settled. The solids may be separated from solution, dried and returned to the smelting vessel. Sodium sulfide in the solution may be substantially oxidized by bubbling an oxygen-bearing gas through the solution, followed by the addition of a small amount of hydrogen peroxide.

As an alternative to a smelting reduction, the lead concentrate is reduced electrolytically in a bath of molten lead chloride with the evolution of elemental sulfur. This process is disclosed in U.S. Pat. No. 2,092,451, hereby included by reference. The process according to the patent comprises separating lead and sulfur from lead sulfide-containing material in fused lead chloride, the fused chloride containing 1–10% lead sulfide. A current is applied at a current density between about 5000 and 10,000 $A/m^2$ to bipolar electrodes with a voltage drop of 1.2 to 1.4 V over each gap. The sulfur is evolved at the anode and is collected and condensed. The lead is evolved at the cathode and is removed in molten state from the cell.

This process may be successfully used for the preparation of a lead with a low alpha count, provided the materials of the cell and electrodes as well as the fused lead chloride electrolyte have no or a low alpha count. Preferably, the cell and the electrodes are made of graphite, and the lead chloride is prepared by chlorination of lead, lead sulfide or lead sulfide concentrate with a low alpha count. In a preferred embodiment, the cell is a cylindrical graphite vessel acting as cathode, and has a single hollow cylindrical anode open at its top and bottom positioned centrally in the vessel some distance above the bottom of the vessel. A suitable cover closes the cell and the anode. A mixing device is centrally located at the lower end of the anode, the shaft of the mixer protruding through the cover. The anode is provided with a number of spaced slots at its lower extremity to improve mixing and with a number of openings at its upper end to allow circulation of electrolyte, as well as to provide passage of evolved sulfur vapor. The cell cover is provided with a passage for the feeding of concentrate into the anode and for the syphoning of molten lead from the bottom of the cell. An opening is provided in the cover for the removal of sulfur vapour. The cell, cover and passages are well-insulated to reduce heat loss.

The process is preferably operated at a temperature maintained in the range of about 500 ° to 600° C., using a concentration of lead sulfide in the lead chloride in the range of about 2.5 to 25%, preferably 10% by weight, maintaining a spacing between anode and vessel wall of about 5 cm, and using a current density in the range of about 6000 to 9000, preferably about 7000 $A/m^2$. Lead sulfide concentrate is continuously added at a rate to maintain the desired concentration in the electrolyte. Molten lead is periodically syphoned from the cell. The electrolyte is skimmed and bled at suitable intervals to remove impurities, and electrolyte is added as required to maintain the desired level in the cell. The electrolyte is agitated at a suitable rate to circulate the cell contents. The lead recovered from the process is low alpha lead with an alpha count of about 0.02 particle per $cm^2$ per hour.

It is noted that the alpha count of lead produced according to the process of the invention remains substantially constant with time.

If desired, the low alpha lead recovered from the reduction processes may be further purified by electro-refining. The electro-refining of lead in a hydrofluosilicic acid or sulphamic acid electrolyte is well known, and may be carried out according to either the well-known Betts Process or the bipolar process, provided that substantially no alpha emitters are present or introduced. As in the reduction processes, the electrolyte, as well as the lead cathode, in case of the Betts Process, must have no or a low alpha count. In the electro-refining of low alpha lead, the lead from a reduction process, as described, is made into anodes that are immersed in the electrolyte and are refined under standard, well known conditions. Refined, low alpha count lead with a reduced impurity content is recovered from the electro refining process.

The invention will now be illustrated by means of the following non-limitative examples.

EXAMPLE 1

This example illustrates the method of the invention.

Coarsely-disseminated lead mineral substantially free of impurities was selected from the carbonate type galena ore body at Pine Point, N.W.T. The ore body was mined and the ore was coarse-crushed to smaller than one inch, fine-crushed to smaller than ⅜ inch using jaw crushers, ground in a pulverizer, and screened to minus 35 mesh. The alpha count of a sample of screened ore was 0.24 alpha particle per $cm^2$ per hour. The screened ore was made into a fluid suspension by the addition of water and subjected to a gravity separation using a Deister table, model RH15SSD. Two hundred and twenty eight kg of lead concentrate containing 84% lead was separated. The alpha count of a sample of the concentrate was 0.02. This concentrate was again subjected to gravity separation yielding a second concentrate containing 86% lead with an alpha count of less than 0.01. A portion of the lead concentrate was mixed with an above stoichiometric amount of sodium carbonate and with sodium chloride, these salts having an alpha count of 0.03. The mixture was smelted with air sparging in a graphite crucible (low alpha count) for six hours at a temperature in the range of 800 ° to 1000° C. Eighty two kg of lead metal, which separated readily from the slag, was recovered. The grade of the lead metal was 99.99%. The alpha count of the recovered metal was less that 0.01. Upon monitoring the count over a period of time, it was determined that the alpha count remained essentially constant.

The results show that low alpha lead can be produced from lead mineral that is coarsely-disseminated in a host rock substantially free of impurities and relatively low in alpha emitters by subjecting crushed ore in a fluid suspension to a gravity separation, and smelting the resulting concentrate with a reducing agent with no or a low alpha count. The results also show that alpha emitters are associated with the host rock.

EXAMPLE 2

Galena ore was hand-picked from the Polaris, Pine Point and Bixby ore bodies. The galena was coarsely-disseminated in a carbonate type host rock and was substantially pure.

The hand-picked galena, which was substantially free of host rock and impurities, each had alpha counts of less than 0.01. Nine hundred grams of hand-picked galena from each ore body was mixed with 600 g of sodium carbonate and 300 g of sodium chloride and smelted in a graphite crucible for two hours at 950° C. Lead metal was recovered from each smelting with an 80% recovery, and was determined to have an alpha count of less than 0.01 in each case. The alpha counts of the lead recovered from each smelting did not increase with time.

The results show that pure galena has a low alpha count and that the alpha count does not increase when the galena is smelted according to the method of the invention.

EXAMPLE 3

This example illustrates that low alpha lead can not be produced by conventional, commercially used processes, even when the lead mineral is present in a coarsely-disseminated form in a low alpha count host rock.

A lead concentrate was produced by crushing, grinding and froth flotation of ore obtained from the Pine Point mine. The alpha count of the lead concentrate was 0.428. This concentrate was subjected to conventional, commercial smelting with the addition of lime-rock, silica and coke. A sample of lead metal recovered from this smelting had an alpha count of 0.06. The alpha count increased, however, with time to a value of 0.17 after twelve months.

Nine hundred grams of the same lead concentrate with an alpha count of 0.428 was smelted as in Example 2. The lead recovered from this smelting had an alpha count of 0.05. The count was also found to increase with time.

The results show that the usual commercial processes used for concentrating lead mineral do not yield a lead concentrate that has even a relatively low alpha count. Furthermore, the results show that neither commercial-type smelting nor smelting with agents that have no or a low alpha count of a froth flotation concentrate yield low alpha lead with an alpha count that remains constant with time.

EXAMPLE 4

This example illustrates the preferred reduction of lead sulfide concentrate using sodium carbonate without the addition of oxygen-bearing gas. A lead concentrate was prepared from Pine Point ore by crushing, grinding and gravity separation as described in Example 1. The concentrate contained 82% lead and had an alpha count of 0.02 alpha particle per $cm^2$ per hour. 2500 g of the lead concentrate was mixed with 1450 g $Na_2CO_3$, i.e., 30% excess over stoichiometric, and 725 g NaCl. 3140 g of the mixture was heated by induction in a graphite crucible to a temperature of 1050° C. The reaction was continued for one hour and 1220 g of lead were subsequently recovered. The recovery was 89%, the grade of lead metal was 99.99%, and the alpha count of the recovered lead metal was less than 0.01. The alpha count did not increase with time.

EXAMPLE 5

The electrolytic cell as described is used for the electrolysis of lead concentrate that was prepared from Pine Point ore by grinding and gravity separation as described in Example 1 and contained 82% lead with an alpha count of 0.02.

The graphite cell has an inside diameter of 40 cm and a height of 60 cm. The cell is filled with an amount of molten lead chloride prepared by the chlorination of low alpha count lead (alpha count less than 0.01). A graphite anode with a diameter of 30 cm and a height of 45 cm is immersed in the bath such that the agitator circulates melt through the openings at the upper end of the anode while leaving space for the passage of evolved sulfur vapor. The space between the anode and the cell wall is 5 cm and that between the anode and the cell bottom is 10 cm.

A non-alternating potential difference is applied between anode and cell wall to give a direct current flow at a density of 0.7 $A/cm^2$ of anode surface. Lead sulfide concentrate is continuously added through the cover into the anode at a rate of 12.5 kg/h. The temperature is 525° C. The electrolyte is agitated and the concentration of lead sulfide in the electrolyte is maintained at about 10% by matching the feed rate to the current flow. Lead is formed at a rate of 10 kg/h and is periodically withdrawn from the bottom of the cell. Sulfur vapor exits from the top of the cell. The withdrawn lead has an alpha count of 0.02 or less.

EXAMPLE 6

Molten lead from the reduction process of Example 1 was poured into anodes and subjected to electro-refining according to the Betts Process. A sample of the lead had a total impurity content of 568 ppm, as determined by spark-source emmission spectroscopy, and had an alpha count of 0.014. Both the lead fluosilicate-fluosilicic acid electrolyte and the lead cathodes were made from low alpha count lead. The lead anodes were immersed in 1.5 L electrolyte and a current of 3 A was applied between cathode and anodes. The cell potential drop was 1.2 V. Electrolysis was continued for 90 h, after which 950 g of lead was recovered. The recovered lead had a total impurity content of 68 ppm and an alpha count of less than 0.01.

It is understood that modifications may be made in the process of the invention without departing from the scope of the appended claims.

We claim:

1. A method for production of lead with a low emission of alpha particles which comprises the steps of selecting an orebody containing lead mineral comprising galena in a coarsely-disseminated form substantially free of impurities, in a carbonate-type host rack together with associated minerals and relatively low in alpha emitters; mining said ore body to produce a mined ore; milling said mined ore to form ground ore having particle sizes such that separation of lead mineral from said host rock and associated minerals can be effected; forming a fluid suspension of said ground ore; subjecting said suspension to a gravity separation to remove said host rock and associated minerals from said lead mineral; recovering said lead mineral as a lead concentrate; subjecting said concentrate to a reduction; carrying out said reduction electrolytically by feeding an amount of said concentrate into an agitated bath of molten lead chloride contained in an electrolytic cell having an anode immersed in said bath, said lead chloride, said cell and said anode having no or a low emission of alpha particles; flowing a direct electrical current between said cell and said anode to provide a current density in the range of about 6000 to 9000 $A/m^2$; maintaining a temperature in the range of about 500° to 600° C.; maintaining a concentration of lead sulfide in said bath in the range of about 2.5 to 25%; and recovering lead having an alpha count of 0.02 particle per $cm^2$ per hour or less from said reduction.

2. A method as claimed in claim 1, wherein said concentrate is continuously added to said bath, the concentration of lead sulfide in said bath is maintained at about 10% by periodically withdrawing molten lead from said cell, said temperature is about 525° C. and said current density is about 7000 $A/m^2$.

3. A method as claimed in claim 1, wherein the lead recovered from said reduction is subjected to electrorefining to reduce its impurity content, said electrorefining being carried out without introduction of alpha particle-emitting substances.

4. A method as claimed in claim 1, wherein said reduction includes a conversion of said lead concentrate into a form that is reducible to lead.

5. A method as claimed in claim 1, wherein said reduction is carried out without the introduction of alpha particle-emitting substances,

* * * * *

UNITED STATES PATENT AND TRADEMARK OFFICE

CERTIFICATE OF CORRECTION

PATENT NO. : 4,915,802

DATED : April 10, 1990

INVENTOR(S) : John A. Dunlop et al

It is certified that error appears in the above-identified patent and that said Letters Patent is hereby corrected as shown below:

The name of the Assignee has been misspelled. On the title page, line [73], change the Assignee from "Comico Ltd., Vancouver, Canada" to --Cominco Ltd., Vancouver, Canada--,

Signed and Sealed this

Twenty-sixth Day of November, 1991

*Attest:*

HARRY F. MANBECK, JR.

*Attesting Officer*

*Commissioner of Patents and Trademarks*